United States Patent [19]

Chister

[11] Patent Number: 4,478,228

[45] Date of Patent: Oct. 23, 1984

[54] TOBACCO SMOKING PIPE

[76] Inventor: René A. Chister, 20702-177 El Toro Rd., El Toro, Calif. 92630

[21] Appl. No.: 431,470

[22] Filed: Sep. 30, 1982

[51] Int. Cl.[3] ..... A24F 1/26; A24F 3/02

[52] U.S. Cl. ..... 131/180; 131/184 A

[58] Field of Search ..... 131/181, 198 R, 330, 131/329, 178, 174, 180, 184 A, 184 B, 228

[56] References Cited

U.S. PATENT DOCUMENTS

| | | | |
|---|---|---|---|
| 1,010,951 | 12/1911 | Prunty | 131/181 |
| 1,011,747 | 12/1911 | Clark | 131/180 |
| 1,050,005 | 1/1913 | Crume et al. | 131/180 |
| 1,232,310 | 7/1917 | Hoefler | 131/180 |
| 1,243,803 | 10/1917 | Bradley | 131/180 |
| 1,545,964 | 7/1925 | Laucks | 131/184 B |
| 2,210,791 | 8/1940 | Blum | 131/181 |
| 2,778,363 | 1/1957 | Anderson | 131/181 |
| 4,252,135 | 2/1981 | Herman | 131/180 |

FOREIGN PATENT DOCUMENTS

| | | | |
|---|---|---|---|
| 8760 | of 1892 | United Kingdom | 131/180 |

*Primary Examiner*—U. Millin
*Assistant Examiner*—Harry J. Macey
*Attorney, Agent, or Firm*—Klein, Szekeres & Fischer

[57] ABSTRACT

A unique pipe configuration including a magazine in which a supply of tobacco may be stored, so that a smoker will not be required to waste excess time and effort to continuously replenish the pipe with new tobacco when a plug of tobacco therein has been exhausted. A desired amount of the tobacco supply is moved from the magazine into a hollow cutting and smoking chamber by means of a manually operated piston. A plug of tobacco is cut from the supply thereof by means of a tobacco cutter and transport device having a cutting surface formed at one end thereof. The cutter and transport device is adapted to ride through the cutting and smoking chamber so as to cut off and move the tobacco plug through the cutting and smoking chamber to a particular location thereof wherein the tobacco plug is smoked. The pipe location at which the tobacco plug is smoked is separated and spaced apart from the communication of the pipe stem with the cutting and smoking chamber. By positioning the tobacco plug at a location apart from the pipe stem, burning tobacco ash will be retained within the cutting and smoking chamber and not drawn along the pipe stem to the mouth of the smoker.

6 Claims, 7 Drawing Figures

TOBACCO SMOKING PIPE

BACKGROUND OF THE INVENTION

1. Field of the Invention

This invention relates to a pipe having a unique configuration including a magazine in which a supply of tobacco may be stored. Cutting and transport means are provided by which to cut off a plug from the tobacco supply and move the plug into a chamber where the plug may be smoked without burning ash therefrom being drawn to the mouth of the smoker by way of the pipe stem.

2. Prior Art

Pipes have been used for many centuries as a means by which to permit tobacco to be smoked. In a conventional pipe, a supply of tobacco is placed within the pipe bowl, and smoke is inhaled by the user through an elongated pipe stem that interfaces with the bowl. However, and as will be known to the frequent pipe smoker, the conventional pipe configuration is characterized by several shortcomings.

More particularly, the stem of the conventional pipe is typically arranged to form a direct passageway from the pipe bowl to the mouth of the user. Consequently, and while a plug of tobacco is being smoked, the smoker may undesirably draw burning tobacco ash from the pipe bowl into his mouth via the pipe stem. Such undesirable action may cause the smoker to burn either his mouth or tongue.

Another common disadvantage of the conventional pipe configuration is the limited amount of space that is commonly available within the bowl to receive a plug of tobacco. Thus, because a plug of tobacco is usually smoked in a relatively short amount of time, the user must frequently take time to replenish the pipe bowl with new supplies of tobacco from a tobacco pouch or cannister. The action of repeatedly supplying the pipe bowl with tobacco is both inconvenient and time consuming. Moreover, the pipe smoker must have ready access to a suitable pouch or cannister.

Still another disadvantage that is associated with the conventional pipe relates to the operation of pipe cleaning. It is customary for the pipe smoker to carry on his person pipe cleaners or similar articles in order to affect a cleaning of the pipe. However, the pipe cleaners may be either lost or forgotten, thereby requiring that the smoker find suitable substitutes. Such substitutes are not always available, and the smoker may be left with no adequate means by which to periodically clean his pipe. Used pipe cleaners are characteristically covered with burnt tobacco residue and, therefore, the reuse and transport thereof on the body of the smoker are undesirable.

Examples of prior art pipes may be found by referring to one or more of the following U.S. patents:

| U.S. Pat. No. | ISSUE DATE |
|---|---|
| 919,515 | April 27, 1909 |
| 1,010,951 | December 5, 1911 |
| 1,011,747 | December 12, 1911 |
| 1,050,005 | January 7, 1913 |
| 1,053,039 | February 11, 1913 |
| 1,213,021 | January 16, 1917 |
| 1,232,310 | July 3, 1917 |

SUMMARY OF THE INVENTION

It is a primary object of the present invention to provide a compact pipe for smoking tobacco, which pipe may be easily disassembled to permit easy cleaning or repair.

It is another object of the present invention to provide a pipe having a magazine in which a supply of tobacco may be stored to replenish an exhausted tobacco plug.

It is yet another object of this invention that the present pipe include a piston for manually forcing a desired amount of the tobacco supply from the magazine into a cutting and smoking chamber and a cutter and transport means for cutting a plug of tobacco from the supply thereof and moving the plug to a location within the cutting and smoking chamber where the plug may be smoked.

It is an additional object of the present invention that the location within the cutting and smoking chamber where the tobacco is smoked is separated and spaced apart from the pipe stem, such that burning tobacco will be trapped within the cutting and smoking chamber and not drawn along the pipe stem to the mouth of the smoker.

It is a further object of this invention that the pipe include a self-contained cleaning brush to which access may be easily gained so that the pipe can be periodically cleaned.

Further objects and advantages of the present invention will become apparent as the following description proceeds and the features of novelty which characterize this invention are pointed out with particularity in the claims annexed hereto.

BRIEF DESCRIPTION OF THE PREFERRED EMBODIMENT

Figure 1:
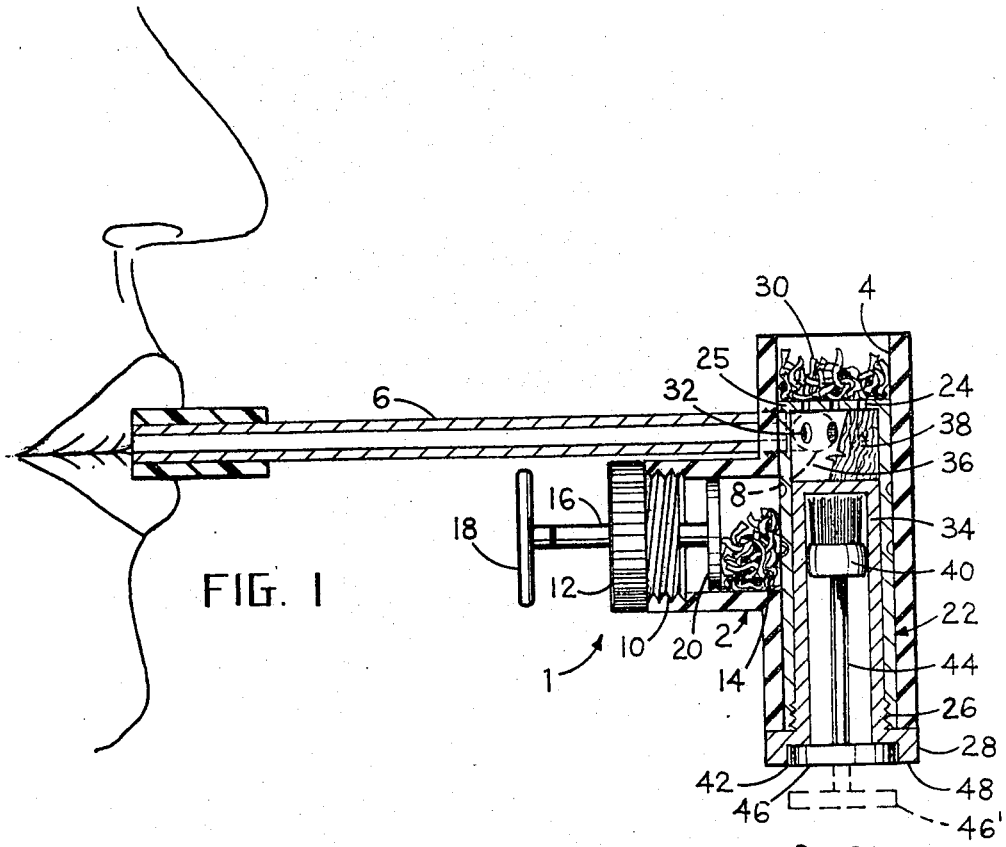
FIG. 1 shows a partial cross-section through the side of the tobacco smoking pipe which forms the present invention.
Figure 2:
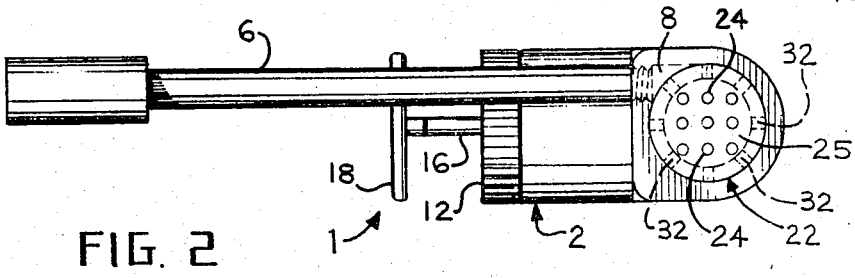
FIG. 2 shows a top view of the pipe of FIG. 1.

The structure of the presently disclosed tobacco smoking pipe is best described while referring concurrently to FIGS. 1 and 2 of the drawings. The body of pipe 1 is preferably fabricated from a durable material such as brass, or the like. However, the material by which to fabricate pipe 1 is not to be considered a limitation of the present invention, and other suitable and well-known materials may, otherwise, be employed herein. The body of pipe 1 includes a hollow tobacco magazine 2 and a hollow and preferably cylindrical tobacco cutting and smoking chamber 4. An elongated pipe stem 6 extends outwardly from tobacco cutting and smoking chamber 4. As will be explained in greater detail hereinafter, tobacco smoke from cutting and smoking chamber 4 may be drawn to the mouth of a smoker by way of pipe stem 6. Pipe stem 6 is preferably screw threaded so as to permit an easy connection to or disassembly from tobacco cutting and smoking chamber 4 at an aperture 8. Aperture 8 is corresponding screw-threaded and extends through the walls of pipe 1 into cutting and smoking chamber 4. so that pipe stem 6 may communicate with chamber 4.

Tobacco magazine 2 has an opened first end which, as is best shown in FIG. 1, communicates with tobacco cutting and smoking chamber 4. The second end of tobacco magazine 2 is provided with screw threads 10, whereby to permit a suitable end cap 12, having corresponding screw threads, to be connected thereat. Accordingly, end cap 12 may be removed from tobacco magazine 2 in order that a suitable supply of tobacco may be stored within magazine 2. End cap 12 has an aperture formed therein so as to accommodate a shaft or rod member 16 therethrough. One end of shaft 16 terminates at a button 18. The other end of shaft 16 terminates at a disk-shaped piston 20. Piston 20 is dimensioned so as to form a relatively snug fit within the walls of tobacco magazine 2. The combination including piston shaft 16 and disk-shaped piston 20 is adapted for reciprocal movement through the interior of tobacco magazine 2 whenever the button end 18 of shaft 16 is manually depressed towards and retracted from the end cap 12 of magazine 2. Accordingly, and as will be detailed during a description of the operation of the present pipe 1, a suitable supply of tobacco 14 may be forced from magazine 2 into tobacco cutting and smoking chamber 4 by depressing button end 18 in a direction towards chamber 4.

A hollow, preferably cylindrically shaped tobacco cutter and transport device 22 is dimensioned so as to form a snug fit within the hollow cutting and smoking chamber 4. A first, cutting end 25 of tobacco cutter and transport device 22 includes a plurality of smoke intake ports 24 formed therein (and best shown in FIG. 2). The second end of cutter and transport device 22 is formed with a series of screw threads 26, whereby a knurled end cap 28, having corresponding screw threads, may be removably connected thereat. Thus, by unscrewing and removing end cap 28, the tobacco cutter and transport device 22 may be removed from tobacco smoking chamber 4 and cleaned. As an important detail of the present invention (the advantage of which will be described hereinafter), tobacco cutter and transport device 22 is particularly dimensioned so that in the assembled relationship (of FIG. 1), the cutting end 25 of device 22 having smoke intake ports 24 formed therein terminates at a location above the intersection (e.g. aperture 8) of pipe stem 6 with cutting and smoking chamber 4. As will be disclosed in detail when referring to FIGS. 4–7 hereinafter, tobacco cutter and transport device 22 is manually operated at knurled end cap 28 and adapted to ride through cutting n and smoking chamber 4, whereby to cause the cutting end 25 thereof to tear a tobacco plug (e.g., 30) away from the magazine supply 14 thereof and transport the tobacco plug upwardly and inwardly through cutting and smoking chamber 4 to a location above aperture 8 and the intersection of pipe stem 6 with chamber 4, at which location the tobacco plug 24 may be ignited and smoked. Thus, the cutting end 25 of cutter and transport device 22 (and the smoke intake ports 24 therein) separates a tobacco plug 30 from the aperture 8 and pipe stem 6 during the time when the tobacco is smoked.

As another important detail of the present invention, a plurality of smoke transfer ports 32 are formed in a circular configuration around the side of cutter and transport device 22 adjacent the cutting end 25 thereof. When in the assembled relationship (of FIG. 1), a pair of the smoke transfer ports 32 are aligned with the aperture 8. In a preferred embodiment of the present invention, and as is best illustrated in FIG. 2, pipe stem 6 is slightly offset with respect to the center of the cylindrically shaped tobacco cutting and smoking chamber 4. Therefore, the aperture 8 formed at the intersection of pipe stem 6 with cutting and smoking chamber 4 is oval-shaped and of sufficient area to cover a pair of the smoke transfer ports 32 so as to enhance the draw of tobacco smoke by the smoker. That is, regardless of the position of tobacco cutter and transport device 22 when received within cutting and smoking chamber 4, aperture 8 is suitably dimensioned and located so as to surround an area at the side of device 22, which area includes a pair of the transfer ports 32. As will be explained shortly, the smoke intake ports 24 formed in the cutting end 25 of cutter and transport device 22 and the smoke transfer ports 32 formed around the side of device 22 are arranged to form a passageway through which tobacco smoke may be inhaled by the smoker from the tobacco plug 30 via pipe stem 6.

As previously disclosed, tobacco cutter and transport device 22 is of hollow construction. A cylindrically shaped, hollow plug member 34 is positioned at the interior of device 22. Plug member 34 is of suitable dimension to form a snug fit when inserted within the interior of cutter and transport device 22. One end of plug member 34 terminates at and is integrally connected to the knurled end cap 28. Thus, when end cap 28 is unscrewed and removed from cutter and transport device 22, plug member 34 is, likewise, withdrawn from (the interior of) device 22. The second end of plug member 34 terminates within tobacco cutter and transport device 22 at a location as best illustrated in FIG. 1) below the aperture 8. Accordingly, an annular space 36 is formed at the interior of tobacco cutter and transport device 22 between the second end of plug member 34 and the cutting end 25 of device 22.

A well-known problem with many conventional pipes is that hot tobacco or ash is frequently drawn from a burning supply thereof to the tongue or mouth of the smoker via the pipe stem. Such burning tobacco ash has been known to cause injury to the smoker. However, and in accordance with the present invention, means are provided by which to substantially prevent hot tobacco from being drawn to the mouth of the smoker, whereby to minimize the risk of injury. More particularly, the smoker ignites a plug 30 of tobacco which has been cut from tobacco supply 14 and transported to the top of cutting and smoking chamber 4 by the cutting end 25 of tobacco cutter and transport device 22. In the assembled pipe configuration of FIG. 1, the burning tobacco plug 30 is supported within cutting and smoking chamber 4 by the cutting end 25 of device 22. Tobacco smoke is inhaled by the smoker from tobacco plug 30 through a path including smoke intake ports 24, annular space 36, a pair of smoke transfer ports 32, and pipe stem 6. It is to be recognized that the longitudinal axes of smoke intake ports 24 (which extend through the cutting end 25 of cutter and transport device 22) and the longitudinal axes of smoke transfer ports 32 (which extend through the side of device 22) project in different directions, which directions are in substantially perpendicular alignment with one another. As an important advantage of the present invention, it has been found that because of the (right) angled smoke path including ports 24 and 32, burning tobacco ash which is drawn by the smoker from tobacco plug 30 into annular space 36 remains trapped within space 36 and along the walls of cutting and smoking chamber 4. Therefore, tobacco smoke being inhaled by way of pipe stem 6 will be substantially devoid of hot tobacco or burning ash.

As an additional embodiment of the present invention, a well-known filter element, designated 38, may be placed within annular space 36 between plug member 34 and the cutting end 25 of tobacco cutter and transport device 22. Hence, burning tobacco ash and other undesirable contaminants may be advantageously trapped within filter element 38. Filter element 38 may be easily replaced by merely unscrewing knurled end cap 28 and removing plug member 34 from the interior of tobacco cutter and transport device 22. Moreover, and unlike conventional pipes which typically include a filter element located within the pipe stem thereof, the presently described filter element 38 is of sufficient size and location to remove undesirable contaminants from the tobacco smoke without unduly restricting the flow of smoke through the pipe stem 6.

Another important feature of the present pipe 1 is best shown in FIG. 1. A cleaning means, such as a brush 40, or the like, having a shaft 44 is disposed at the interior of hollow plug member 34. An opening 42 is formed through knurled end cap 28 so that brush 40 may be removed from or inserted into the body of plug member 34. Brush shaft 44 has a button-shaped top portion 46 connected thereto opposite brush 40. Knurled end cap 28 has a raised lip 48 formed around the perimeter thereof. The button-shaped top portion 46 of brush shaft 44 is received, in the assembled relationship of FIG. 1, within the opening 42 in end cap 28 so as to lie flush with raised lip 48. When it becomes desirable to clean the present pipe 1, the smoker grips the button portion 46 with his fingers and withdraws button portion 46 from the lip 48 at end cap 28. Accordingly, the shaft 44 and brush 40 are withdrawn (shown in phantom and illustrated at reference numeral 46') from the interior of hollow plug member 34, so that the self-contained cleaning means (i.e., brush 40) may be conveniently used to clean the present pipe 1 (and particularly the smoke intake ports 24 in the cutting end 25 of cutter and transport device 22) when the component parts thereof are disassembled.

Figure 3:
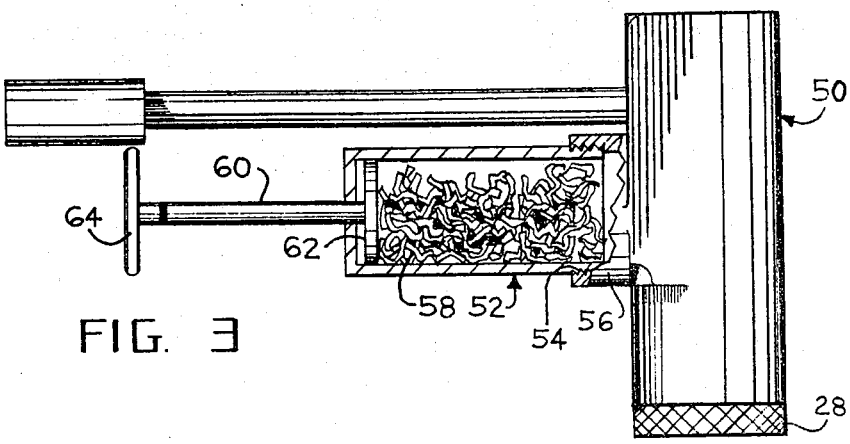
FIG. 3 shows a modification to the pipe which forms the present invention.

FIG. 3 of the drawings shows a modification of the pipe structure of FIGS. 1 and 2. The pipe 50 of FIG. 3 is of similar construction to that illustrated and disclosed when referring to FIGS. 1 and 2. However, pipe 50 includes a tobacco magazine 52 which may be removably connected to the pipe body and to the tobacco cutting and smoking chamber. More particularly, one end of tobacco magazine 52 includes suitable screw threads 54. The body of pipe 50 has a flange 56 coextensively formed therewith and extending outwardly therefrom. Flange 56 has a corresponding set of screw threads so as to receive the tobacco magazine 52 thereat. In the event that a supply of tobacco 58 which is stored within magazine 52 becomes exhausted, the smoker may unscrew magazine 52 from flange 56 and either reload magazine 52 with a new tobacco supply or substitute a new tobacco filled magazine therefor. As shown in FIG. 3, tobacco magazine 52 may have any convenient size in order to accommodate a suitable amount of tobacco 58 therewithin and minimize the need for the smoker to continuously replenish an exhausted tobacco supply.

The opposite end of tobacco magazine 52 has an aperture formed therein through which to receive a piston shaft 60. One end of piston shaft 60 has a disk-shaped piston 62 formed thereat. The other end of shaft 60 includes a button end 64. Button end 64 may be depressed so as to cause shaft 60 and piston 62 to ride through the interior of tobacco magazine 52 and thereby manually force a plug of tobacco from magazine 52 into the cutting and smoking chamber (not shown). Thus, the operation of piston members 60, 62 and 64 with tobacco magazine 52 is the same as that described when referring to the tobacco magazine 2 of FIGS. 1 and 2.

Figure 4:
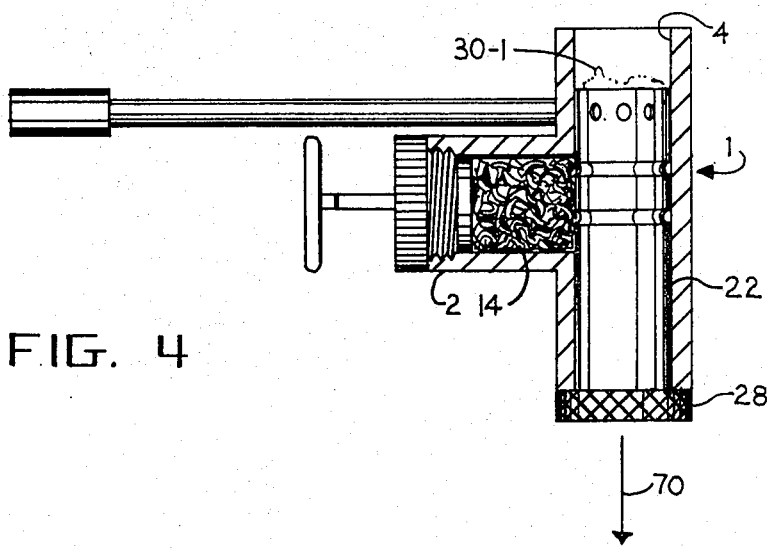
FIGS. 4 through 7 illustrate, in partial cross-section, the operation of the pipe which forms the present invention.

The operation of the presently disclosed tobacco smoking pipe 1 is now described while referring concurrently to FIGS. 4–7 of the drawings. FIG. 4 shows the pipe 1 with tobacco magazine 2 fully loaded with a supply of tobacco 14. In FIG. 4, a plug of tobacco (designated 30-1) within cutting and smoking chamber 4 has been smoked, and the smoker is ready to replenish the exhausted plug with fresh tobacco from magazine 2. Accordingly, the smoker grasps the end cap 28 of tobacco cutter and transport device 22 and moves device 22 downward and outwardly through chamber 4 in the direction indicated by the arrow 70.

Figure 5:
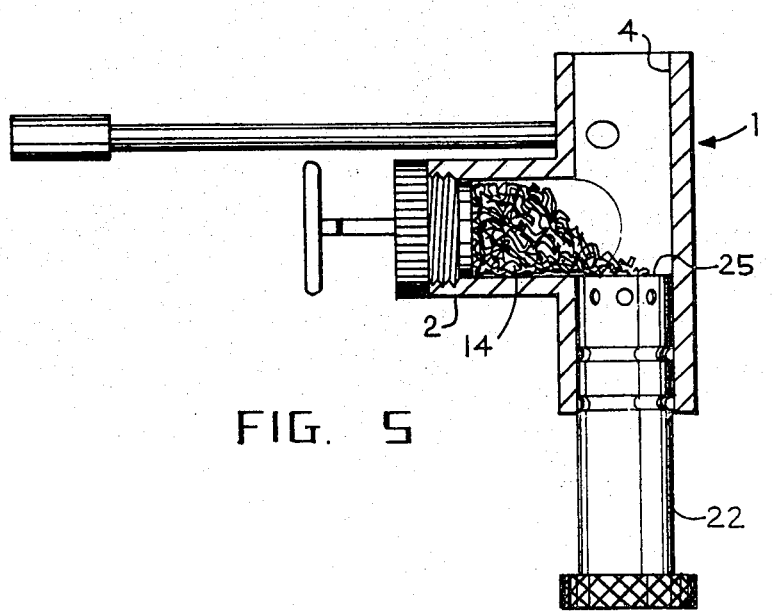

FIG. 5 shows the position of tobacco cutter and transport device 22 within tobacco cutting and smoking chamber 4 before fresh tobacco is moved into cutting and smoking chamber 4 from tobacco magazine 2. That is, the cutting end 25 of device 22 is positioned below the interface of magazine 2 with cutting and smoking chamber 4 so as to permit communication between the stored tobacco supply 14 and chamber 4.

Figure 6:
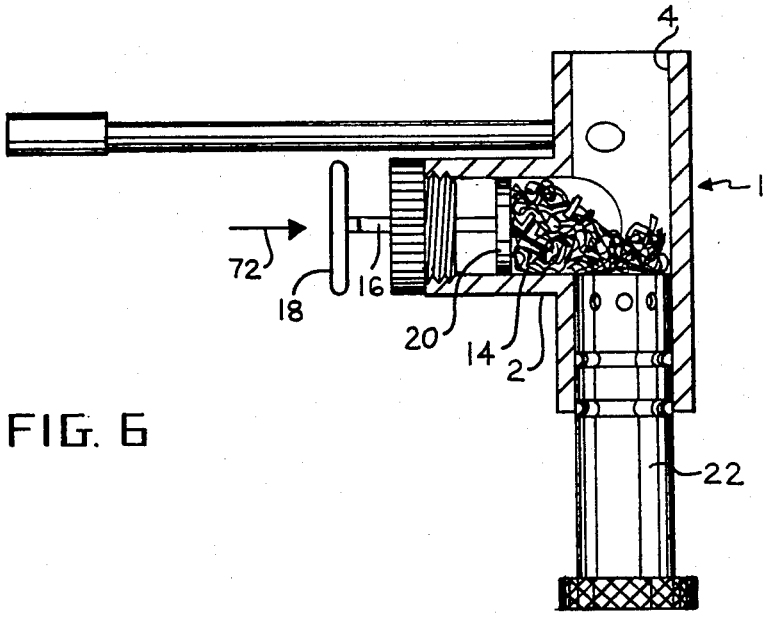
Figure 7:
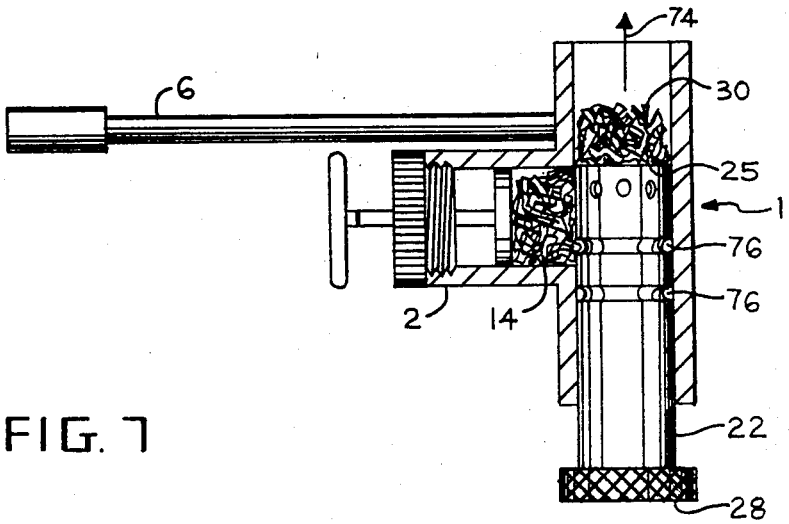

In FIG. 6, a desired amount of tobacco from magazine supply 14 is moved from magazine 2 into tobacco cutting and smoking chamber 4. As previously disclosed, the button end 18 of piston shaft 16 is manually depressed in a direction towards chamber 4, as indicated by arrow 72, so as to cause disk-shaped piston 20 to travel through the interior of magazine 2, whereby to move the tobacco supply 14 from magazine 2 into chamber 4.

In FIG. 7, the smoker again grasps the end cap 28 of tobacco cutter and transport device 22 and moves device 22 upward and inwardly through tobacco cutting and smoking chamber 4 in the direction indicated by the arrow 74. During the inward ride of cutter and transport device 22 through chamber 4, a plug 30 of tobacco is cut or torn away from the magazine supply 14 thereof by the cutting end 25 of cutter and transport device 22. As the cutting end 25 of device 22 travels through cutting and smoking chamber 4, the tobacco plug 30 is transferred to a location above the intersection of pipe stem 6 with chamber 4 (best shown in FIG. 1). Tobacco cutter and transport device 22 is returned to the assembled position (of FIG. 1), whereupon the fresh tobacco plug 30 is now ready to be smoked. When tobacco plug 30 is spent, the smoker may replenish the exhausted plug by repeating the process described while referring to FIGS. 4–7. Therefore, the smoker will have relatively quick access to a renewed plug of tobacco (from magazine 2) with less inconvenience than that encountered when reloading the bowl of a conventional pipe from a tobacco pouch or cannister.

As previously described when referring to FIG. 1, the presently disclosed pipe may be easily disassembled for the purpose of cleaning (such as by means of the self-contained brush 40) or repair. More particularly, tobacco cutter and transport device 22 may be withdrawn from tobacco cutting and smoking chamber 4 so as to permit access to chamber 4. Moreover, knurled end cap 28 may be unscrewed and removed together with plug member 34 from cutter and transport device 22, so as to expose the interior of device 22 and permit access to the filter element 38 located therewithin. Tobacco magazine 2 may be reloaded with tobacco or cleaned by unscrewing and removing end cap 12 (and piston 20) therefrom.

It will be apparent that while a preferred embodiment of the invention has been shown and described, various modifications and changes may be made without departing from the true spirit and scope of the invention. By way of example, and referring once again to FIG. 7, tobacco cutter and transport device 22 may have one or more grooves 76 formed therein and extended around the cylindrical body thereof. Grooves 76 are sized to engage the magazine tobacco supply 14 during the reciprocal movement of cutter and transport device 22 through tobacco cutting and smoking chamber 4. Thus, grooves 76 receive some of the tobacco supply 14 therewithin, whereby to cause tobacco cutter and transport device 22 to be retained at the interior of smoking chamber 4. It might also be appreciated that the movement of piston 20 through magazine 2 acts to compress the tobacco supply 14 against device 22. Accordingly, a relatively larger and better packed supply of tobacco may be stored within magazine 2.

Having thus set forth a preferred embodiment of the present invention, what is claimed is:

1. A tobacco smoking pipe having a smoking chamber for receiving a plug of tobacco to be smoked and a pipe stem connected to said smoking chamber so that tobacco smoke can be drawn therethrough to the mouth of the smoker, said pipe comprising:

tobacco magazine means communicating with said smoking chamber for storing a supply of tobacco to be smoked, means by which to move an amount of tobacco from the supply thereof in said magazine into said smoking chamber, tobacco cutting and transporting means having at least one side wall and a cutting and transporting surface formed at an end of said side wall to define an interior, said cutting and transporting means being dimensioned to travel through said smoking chamber in orer to cause said cutting and transporting end surface to both cut off a plug of the tobacco that has been moved from said magazine into said cutting chamber and transport said tobacco plug to a location in said smoking chamber that is separated from the location of the connection of said pipe stem to said smoking chamber, said cutting and transporting end surface having at least one smoke intake port extending therethrough through which tobacco smoke can be drawn, and a plug member removably positioned at the interior of said cutting and transporting means and associated therewith to establish a space at the interior of said cutting and transporting means, said space extending at least between the smoke intake port of said cutting and transporting end surface and the connection of said pipe stem to said smoking chamber, so that burning tobacco ash that is drawn through said intake port from the tobacco plug can be retained in said space until said plug member is removed from the interior of said cutting and transporting means in order to permit the removal of the burnt tobacco ash and the cleaning of said cutting and transporting means interior.

2. The tobacco smoking pipe recited in claim 1, wherein said pipe stem is connected to said smoking chamber at an aperture through which tobacco smoke is drawn when the plug of tobacco is smoked, said aperture extending longitudinally in a first direction through said pipe stem, said smoke intake port extending longitudinally through the cutting and transporting end surface of said tobacco cutting and transporting means in a second direction, said first and second directions being in substantially perpendicular alignment with respect to one another, so that burning tobacco ash from the plug thereof which may be drawn through said smoke intake port is conveyed to said space formed at the interior of said cutting and transporting means but not drawn through said aperture and into said pipe stem.

3. The tobacco smoking pipe recited in claim 1, wherein said side wall has at least one smoke transfer port extending therethrough and aligned with the aperture at the connection of said pipe stem with said smoking chamber, so that tobacco smoke can be drawn from the tobacco plug through a path including the smoke intake port at the cutting and transporting end surface of said tobacco cutting and transporting means, the space formed at the interior of said cutting and transporting means, the smoke transfer port at said sidewall of said cutting and transporting means, and said pipe stem.

4. The tobacco smoking pipe recited in claim 3, further comprising filter means disposed within the space formed at the interior of said tobacco cutting and transporting means between said smoke intake and transfer ports.

5. The tobacco smoking pipe recited in claim 1, wherein said tobacco magazine means is removably connected to said smoking chamber.

6. The tobacco smoking pipe recited in claim 1, further comprising pipe cleaning means, said plug member having a construction so as to removably receive said pipe cleaning means at the interior thereof.

* * * * *